US007255343B2

(12) United States Patent
So

(10) Patent No.: US 7,255,343 B2
(45) Date of Patent: Aug. 14, 2007

(54) MEDIA SENSING METHOD OF MEDIA DISPENSER

(75) Inventor: Sang Young So, Iksan (KR)

(73) Assignee: LG N-Sys Inc., Seoul (KR)

( * ) Notice: Subject to any disclaimer, the term of this patent is extended or adjusted under 35 U.S.C. 154(b) by 567 days.

(21) Appl. No.: 10/722,436

(22) Filed: Nov. 28, 2003

(65) Prior Publication Data

US 2004/0104238 A1 Jun. 3, 2004

(30) Foreign Application Priority Data

Dec. 2, 2002 (KR) ..... 10-2002-0075823
Dec. 11, 2002 (KR) ..... 10-2002-0078865

(51) Int. Cl.
*B65H 7/12* (2006.01)

(52) U.S. Cl. ..... 271/262; 271/263; 271/265.04

(58) Field of Classification Search ..... 271/262, 271/263, 265.04

See application file for complete search history.

(56) References Cited

U.S. PATENT DOCUMENTS 4,910,488 A * 3/1990 Davis et al. ..... 336/83
5,029,837 A * 7/1991 Uchiyama ..... 271/110
5,437,445 A 8/1995 Chang et al.
5,701,114 A * 12/1997 Chass ..... 336/115
2003/0011464 A1* 1/2003 Eck et al. ..... 338/123
2003/0042300 A1* 3/2003 So ..... 235/379

FOREIGN PATENT DOCUMENTS

JP 11-124252 A 5/1999

* cited by examiner

*Primary Examiner*—David H. Bollinger
(74) *Attorney, Agent, or Firm*—Birch, Stewart, Kolasch & Birch, LLP

(57) ABSTRACT

A media sensing method of a media dispenser is disclosed capable of discriminating various media and accurately discriminating whether a media is normal by using the least sensors. The media sensing method of a media dispenser includes: setting an initial reference range for width and thickness of a media; comparing the initial reference range and a reference range of a currently discharged media; and variably setting a new initial reference range on the basis of the comparison value, thereby discriminating whether media is normal or abnormal. Accordingly, without using an additional sensor, a cost in manufacturing the media dispenser can be reduced, an error caused by various environmental conditions or a deflection taking place in setting sensors can be effectively prevented, a multi-media overlap can be accurately discriminated, and the thickness of discharged multimedia can be precisely measured.

29 Claims, 11 Drawing Sheets

MEDIA SENSING METHOD OF MEDIA DISPENSER

This Nonprovisional application claims priority under 35 U.S.C. § 119(a) on Patent Application Nos. 75823/2002 and 78865/2002 filed in Korea on Dec. 2, 2002, and Dec. 11, 2002, respectively, the entire contents of which are hereby incorporated by reference.

BACKGROUND OF THE INVENTION

1. Field of the Invention

The present invention relates to a media dispenser and, more particularly, to a media sensing method of a (small) media dispenser capable of discriminating various media and accurately discriminating whether a media is normal.

2. Description of the Background Art

Currently, as information communication technologies are developed, a cash dispenser can perform diverse foreign currency processing work as well as a banking work such as money deposit or money withdrawal.

FIG. 1 is an exemplary view showing a construction of a general media dispenser.

As shown in FIG. 1, the general media dispenser includes a first convey path 40 formed at a front side of a cassette that can receive media such as a bill or a check and conveying bills discharged by a discharge roller 30 by means of a convey belt, and a second convey path 50 branched from the first convey path 40 and discharging bills by means of a convey belt. In addition, a retrieval path 60 branched from the first convey path 50 and retrieving an abnormal bill is formed by a convey belt.

In order to forwardly rotate or reversely rotate the convey belt, there is provided a drive motor 10 for rotating a drive roller 20. And in order to selectively convey a bill to the second convey path 50 or the retrieval path 60 from the first convey path 40, there is provided a gate unnumbered which is operated by solenoid.

At the front surface of the discharge roller 30, there are provided a sensor 71 for sensing a discharged bill, a sensor 72 for sensing a bill being conveyed on the first convey path 40, a sensor 73 for sensing a bill conveyed on the second convey path 50, a sensor 74 for sensing a bill being retrieved due to a bill-overlap occurrence on the retrieval path 60, and a control board 80 for checking whether each sensor is normal and controlling driving of each part when a bill discharge command is received by a client's request.

A bill sensing method of the media dispenser constructed as described above will now be explained.

FIGS. 2A to 2D illustrate cases that bills are normally or abnormally sensed for a bill discriminating factor.

With reference to FIG. 2A, if two bills overlap, the detected width is longer than a normal case, so the discharged bill is considered to be abnormal.

With reference to FIG. 2B, the distance between a currently discharged bill and the next discharged bill is measured, and if the distance is smaller than the normal case, the discharged bill is considered to be abnormal.

With reference to FIG. 2C, a tilt of the bill is measured, and if the bill is tilt, the bill is considered to be abnormal.

With reference to FIG. 2D, the thickness of bills, and if two bills overlap, the discharged bill is considered to be abnormal.

As shown in FIGS. 2A to 2D, the media dispenser uses various sensors to discriminate whether the bill is normal. For instance, an RVDT (Rotary Variable Differential Transducer) sensor determines a thickness of a bill according to a difference value between a sense signal value of the RVDT sensor obtained as a sensing unit of the RVDT sensor is lifted up after the bill is conveyed and a pre-set sense signal value. Feed sensors are installed at a left side and a right side in the media dispenser to discriminate a width of the bill. A distance sensor measures a distance between bills. A skew sensor discriminates whether a bill is skewed. Through the plurality of optical sensors, it is discriminated whether a bill is normal.

FIG. 3A illustrates a waveform of a media thickness detect signal detected through the general media dispenser.

As shown in FIG. 3A, the control board 80 of the media dispenser compares a level of a bill thickness detect signal detected by the RVDT sensor with a pre-set reference range signal level. That is, the reference range signal level is compared with a single upper signal level and a single lower signal level. For example, if a bill thickness detect signal (A) included in the reference range signal level is detected, it is determined that one bill is being normally discharged. If a bill thickness detect signal (B) going beyond the reference range signal level is detected, it is determined that one or more bills are being abnormally discharged and the currently discharged bills are discharged to an internal retrieval box.

FIG. 3B illustrates a waveform of a bill width detect signal detected through the general media dispenser.

As shown in FIG. 3B, while a bill is being conveyed along the convey path having the feed sensor, a voltage value of a light receiving part of the feed sensor continuously maintains 0V until the bill passes, and then converted into +5V after the bill passes. Thus, the length of the bill is measured by measuring a time at which the voltage value is converted from +5V to 0V. And then, the level of the bill width detect signal detected by the feed sensor is compared with the pre-set reference range signal level, and if a bill width detect signal (C) going beyond the reference range signal level, it is determined that one or more bills are being abnormally discharged and the currently discharged bills are discharged to the internal retrieval box.

The media dispenser performs a media discrimination with various bill thickness ranges (0.06~0.17 mm) of many countries. That is, since a bill thicker than 0.20 mm does not exist, measurement and discrimination of the bill are performed only in the case of the thickness of below 0.20 mm. Therefore, the conventional media dispenser can not be applied to various multi-media each having a certain range.

In addition, in the conventional art, a normal bill and an abnormal bill are discriminated by comparing a fixed range value for width and thickness of a bill and a range value measured by the sensor.

However, the measured actual width and thickness values of a bill may vary depending on a deflection occurring when setting a sensor and an environment condition. For example, there may occur a mechanical error in the RVDT sensor which measures the thickness of a bill. In addition, due to the specific characteristics of the bill, the measure thickness value can be higher at a low temperature and low moisture compared to a room temperature, and conversely, it is lower at a high temperature and high moisture due to the opposite phenomenon. The conventional art fails to solve these problems.

SUMMARY OF THE INVENTION

Therefore, an object of the present invention is to provide a media sensing method of a media dispenser capable of discriminating various media and accurately discriminating whether a media is normal by using the least sensors.

Another object of the present invention is to provide a media sensing method of a media dispenser capable of accurately determining width and thickness of a media through an RVDT sensor and a feed sensor.

Still another object of the present invention is to provide a media sensing method of a media dispenser capable of determining various kinds of media.

To achieve these and other advantages and in accordance with the purpose of the present invention, as embodied and broadly described herein, there is provided a media sensing method of a media dispenser including: setting an initial reference range for width and thickness of a media; comparing the initial reference range and a reference range of a currently discharged media; and variably setting a new initial reference range on the basis of the comparison value.

To achieve the above objects, there is also provided a media sensing method of a media dispenser including: setting an initial reference range for width and thickness of a media; obtaining an average value of thickness and width of bills accumulatively stored by discharging sample media and setting a reference range; comparing the reference range for the thickness and width of the sample media and the initial reference range, and variably setting the initial reference range; and respectively comparing the variably-set reference range and a reference range of a currently discharged media according to a media withdrawal request, and determining whether the media is normal or not.

To achieve the above objects, there is also provided a media sensing method of a media dispenser including: setting a multi-media discharge mode; setting an initial reference range by shifting a reference value of an RVDT sensor as much as a predetermined value; receiving a multi-media and detecting a voltage according to the thickness of the multi-media; comparing a voltage value according to the thickness of the initial reference range and a voltage value according to the thickness of the currently discharged multi-media; and rejecting the currently discharged multi-media if the detected voltage value of the currently discharged multi-media is greater than the initial reference range voltage value, and discharging the multi-media if the detected voltage value of the currently discharged multi-media is smaller than or the same as the initial reference range voltage value.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
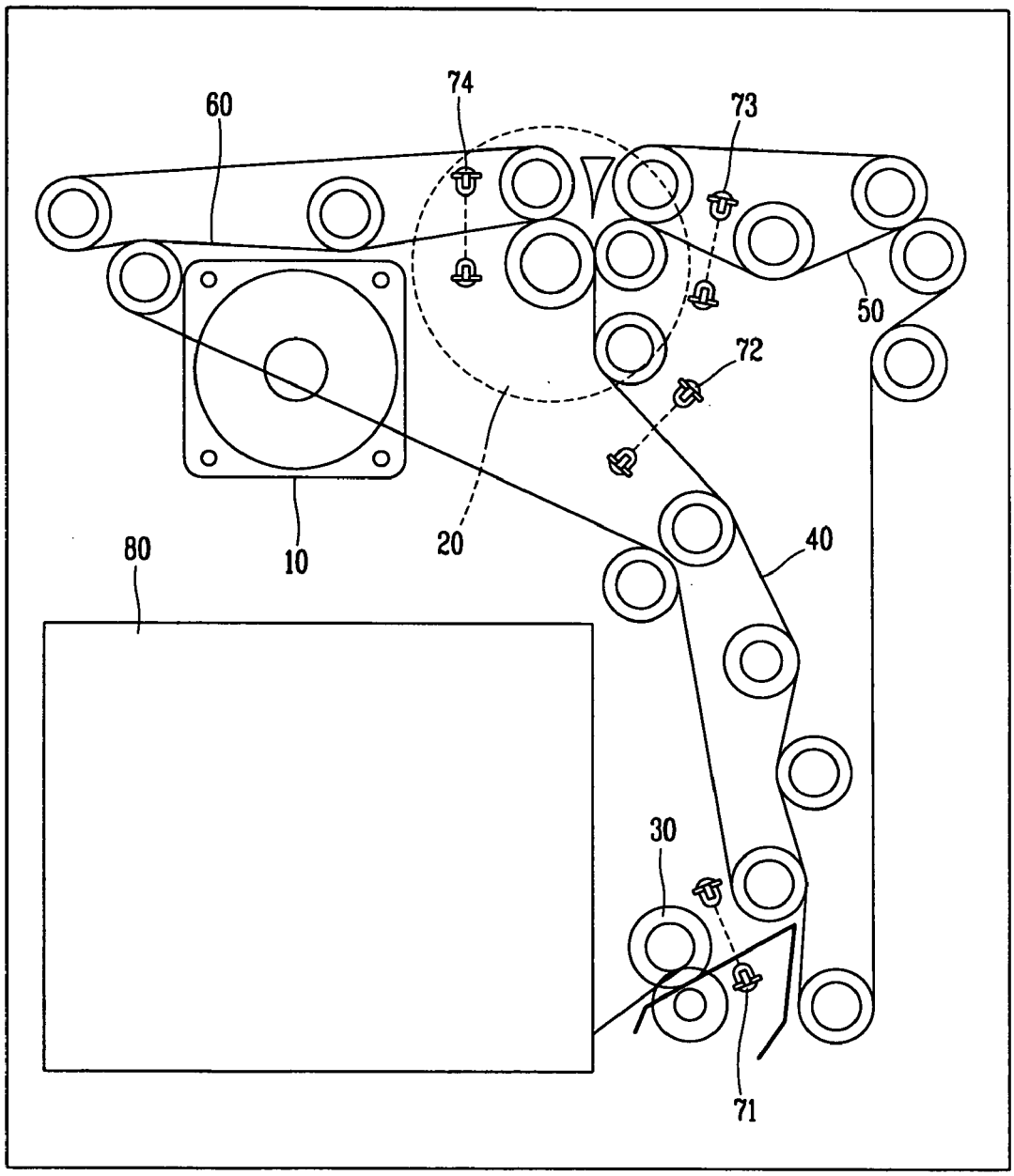
FIG. 1 is an exemplary view showing a construction of a general media dispenser.
Figure 2A:
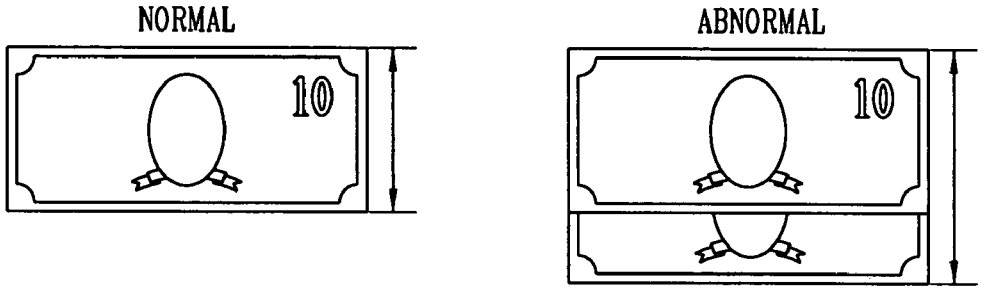
FIGS. 2A to 2D are exemplary view showing respective bills that are sensed to be normal or abnormal for each bill discriminating factor.
Figure 2B:
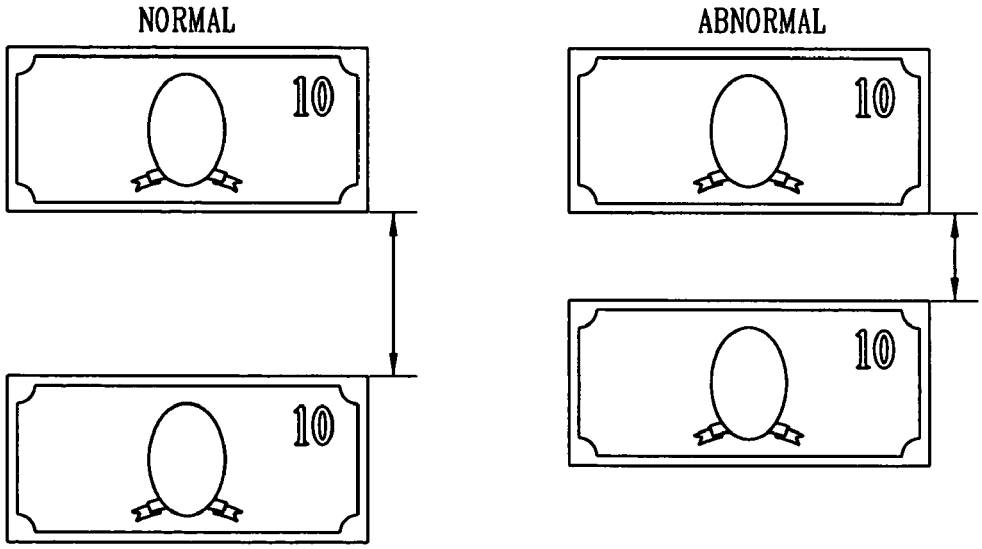
Figure 2C:
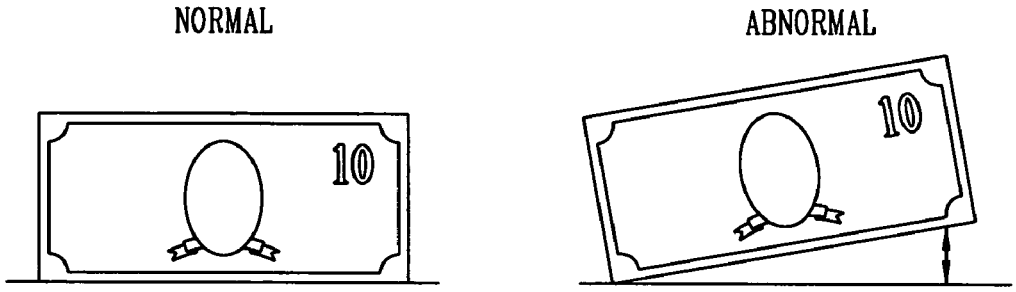
Figure 2D:
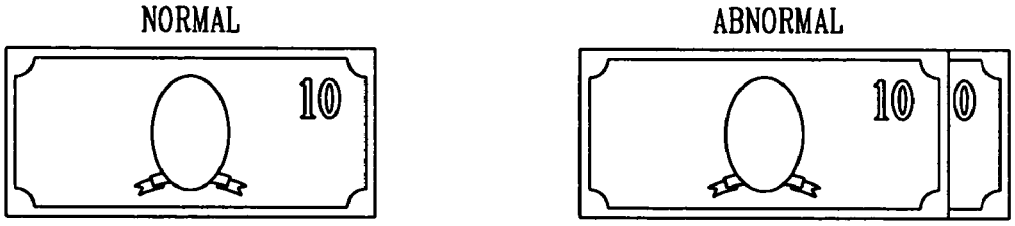
Figure 3A:
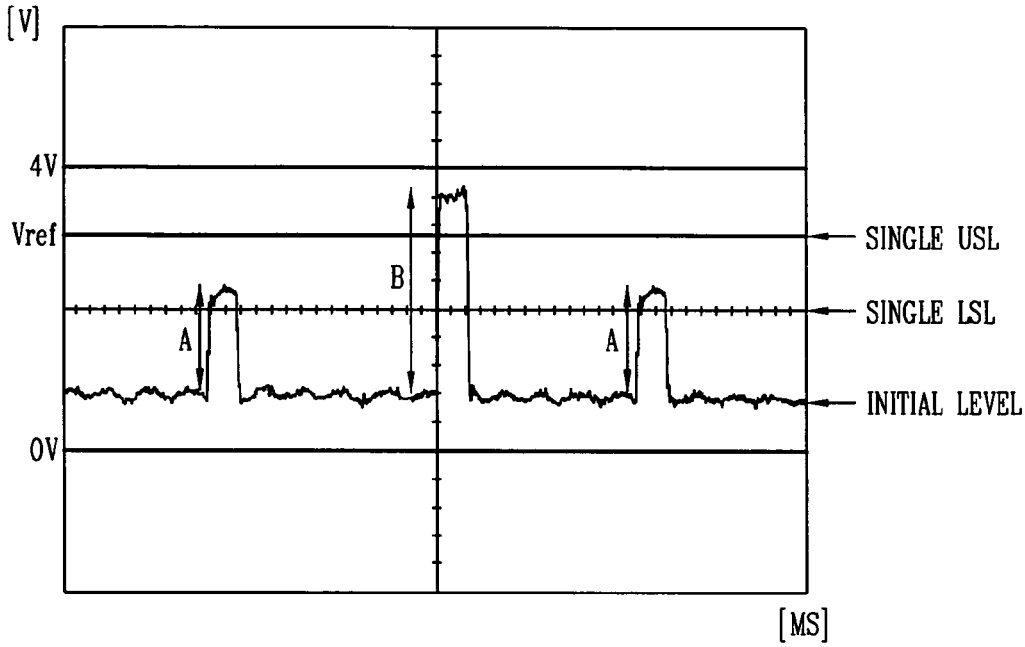
FIG. 3A illustrates a waveform of a bill thickness detect signal detected through the general media dispenser.
Figure 3B:
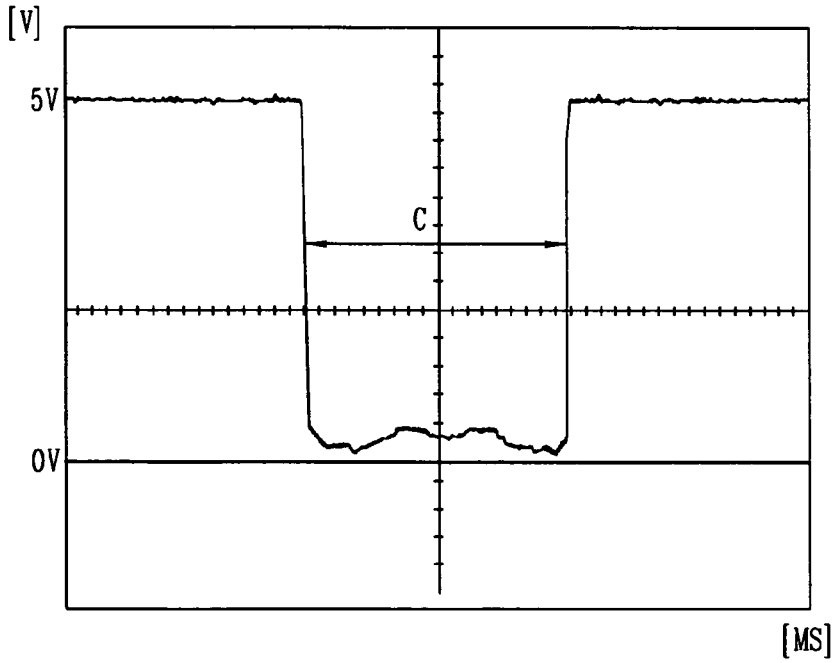
FIG. 3B illustrates a waveform of a bill width detect signal detected through the general media dispenser.
Figure 4:
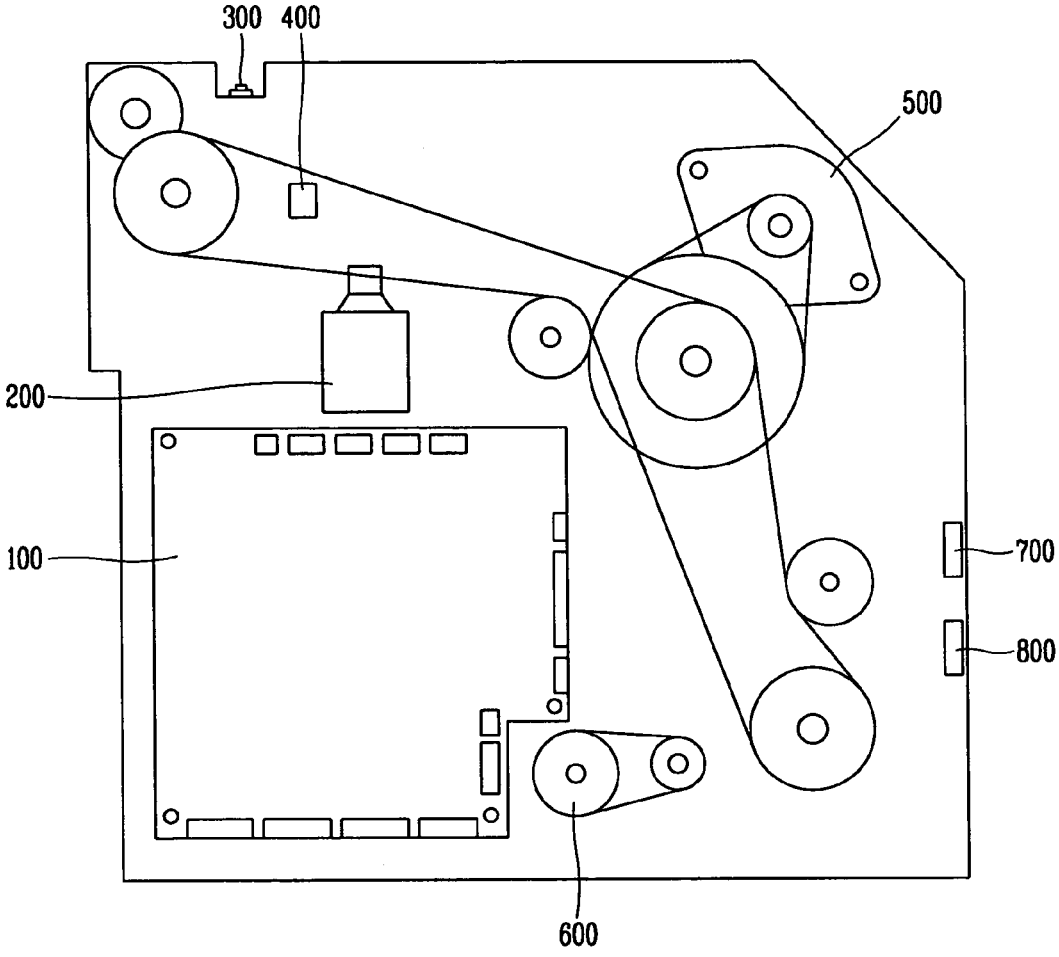
FIG. 4 is an exemplary view showing the interior of a media dispenser in accordance with the present invention.

FIG. 4 is an exemplary view showing the interior of a media dispenser in accordance with the present invention.

As shown in FIG. 4, the media dispenser includes a drive motor 500 for receiving power from a power source and transferring a driving force for operating a belt (or the like) or a gear (or the like); a solenoid 200 for outputting a control signal to retrieve media into a retrieval box when defective media is detected or two or more media are detected on the path on which media is moved; a clutch 600 for selectively transferring a driving force generated from the drive motor 500 to a cassette storing media for media discharging; a feed sensor 800 installed on the media-moving path and outputting a sense signal by counting media or discriminating a state of media by sensing passing of media; an RVDT sensor 700 installed on the media-moving path, discriminating the thickness of media and outputting a sense signal; an eject sensor 300 for counting media being discharged outwardly; a reject sensor 400 for counting media being retrieved; and a control board 100 for controlling operations of each element of the media dispenser.

The drive motor is a DC motor, and preferably, it uses a BLDC (Brushless DC) motor. The feed sensor 800 is an optical sensor consisting of a light emitting unit for radiating light and a light receiving unit disposed at a certain space from the light emitting unit and sensing light radiated from the light emitting unit.

The operation of the media dispenser constructed as described above will now be explained.

First, in a media discriminating method of the media dispenser in accordance with the present invention, a reference range for determining normal media and abnormal media is not fixed but varied in a setting process. That is, an initial reference range is set, and then the initial reference range is compared with currently discharge media. Accordingly to the comparison result, the initial reference range is varied and applied when media is discharged.

Therefore, the media dispenser of the present invention can accurately discriminate normal media and abnormal media regardless of a deflection among sensors or various environmental conditions, compared to the conventional art.

Figure 5:
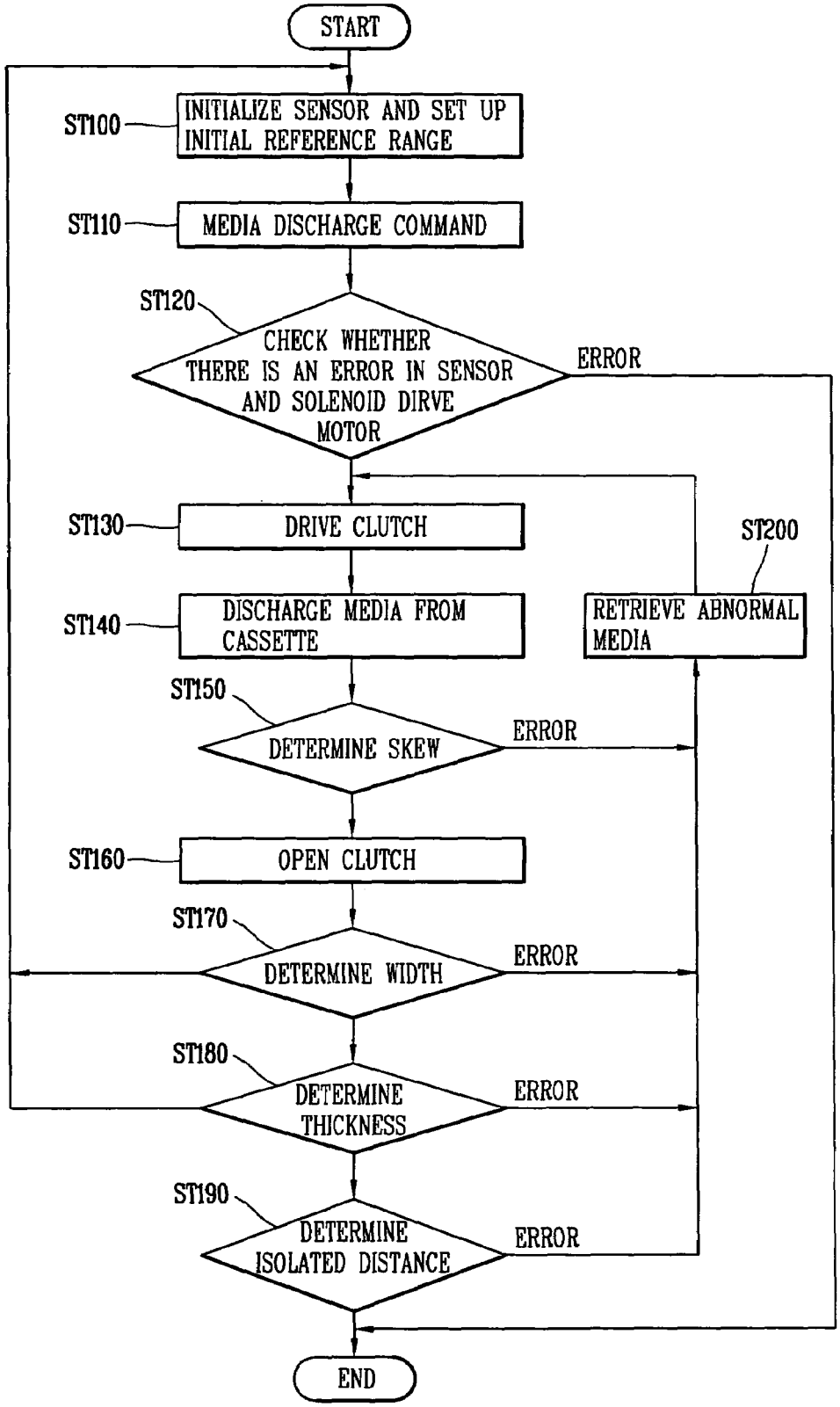
FIG. 5 illustrates a flow chart of an operation of the media dispenser in accordance with the present invention.

FIG. 5 illustrates a flow chart of an operation of the media dispenser in accordance with the present invention.

As shown in FIG. 5, when a system of the media dispenser is turned on, the control board 100 performs a series of initial operations for initializing each sensor as described above. And at the same time, the control board temporarily sets a reference range for a previously set width and thickness of media (ST100). For example, when the media dispenser is turned on/off, the controller temporarily sets and stores an initial reference range for the width and thickness of media through an internal application program or an ESPROM, or sets and stores a reference range of currently discharged media, and feeds back the stored current reference range to vary the initial reference range.

Thereafter, sensors are checked as to whether they are normal according to a media discharge command of a user, and each state of a drive motor 500 and a solenoid 200 is checked (ST100 and ST120). If the solenoid 200 senses that there is a residual media on the moving path, it outputs a sense signal to the control board 100 and the control board 100 outputs a control signal for retrieving the residual media to the drive motor 500. Then, the reject sensor 500 senses and counts the retrieved media, and when the media retrieving operation is completed, the reject sensor outputs a control signal for performing a media withdrawing operation to the control board 100.

Subsequently, the clutch 500 for transferring a driving force to a convey roller connected to the cassette is driven to discharge the media from the media-stored cassette, and accordingly, the media is discharged from the cassette (ST130 and ST140).

The media dispenser includes a feed sensor 800 and an RVDT sensor 700 at the convey path through which media is discharged, in order to sense media being discharged from the cassette.

Discrimination of whether media is normal or not through the feed sensor 800 and the RVDT sensor 700 is as follows.

To begin with, when media discharged from the cassette is moving on the convey path, skewing of media is first discriminated by the RVDT sensor 700 before the feed sensor 800 recognizes it (ST150) That is, skewing of the media is determined according to a sequential order of sensing of the RVDT sensor 700 and the feed sensor 800.

Thereafter, the clutch cuts off the discharged media by interrupting the driving power transferred to the convey roller connected to the cassette (ST160).

Discrimination of the width of the media is made by measuring ON/OFF time of the feed sensor 800 that the media passes along the convey path (ST170). Namely, when media discharged from the cassette passes the convey path where the feed sensor 800 is installed, light radiated from the light emitting unit is cut off by the media, which is sensed by the light receiving unit. The light receiving unit outputs a corresponding sense signal to the control board. For example, a voltage value of the light receiving unit of the feed sensor 800 is continuously maintained at 0V and then converted into +5 after the media passes. Accordingly, the time at which the voltage value is converted from +5V to 0V can be measured.

Discrimination of the thickness of the media can be made by measuring the thickness through the RVDT sensor 700 (ST180). At this time, the control board 100 senses the thickness of media by comparing a sense signal for a media thickness value applied from the RVDT sensor 700 and a sense signal for a pre-set media thickness value. For example, if the value applied from the RVDT sensor 700 is greater than the pre-set value, it is determined that two or more overlapped media are being conveyed. Accordingly, the control board 100 operates the solenoid 200 to output a control signal for retrieving the media. Meanwhile, besides the case that the media is a bill, the same method can be applied to multi-media having a certain thickness such as a ticket.

As for discrimination of a distance between media, the distance between media that are consecutively discharge is measured by measuring the distance between the first media and the next media by using the feed sensor 800 (ST190).

If an abnormal media is sensed during the discriminating process, the control board 100 outputs a control signal for turning on the solenoid 200 and retrieves the media to the retrieval box (ST200). At this time, the reject sensor 400 senses and counts the retrieved media, and outputs a sense signal to the control board 100. Accordingly, the control board 100 determines that the media retrieval operation has been completed, and outputs a control signal for performing the normal media withdrawing operation again.

Finally, a media discharge mode and a multi-media discharge mode are discriminated through a dip switch in order to discharge the media or the multi-media outwardly, or a media discharge command signal and a multi-media discharge command signal are discriminated in order to discharge the media or the multi-media outwardly according to a corresponding command signal. For example, a cassette for supplying a bill when media is the bill, and a cassette for supplying multi-media when media is the multi-media are respectively provided in order to individually discharge the bill and the multi-media, or the bill and the multi-media can be supplied through one cassette.

Figure 6:
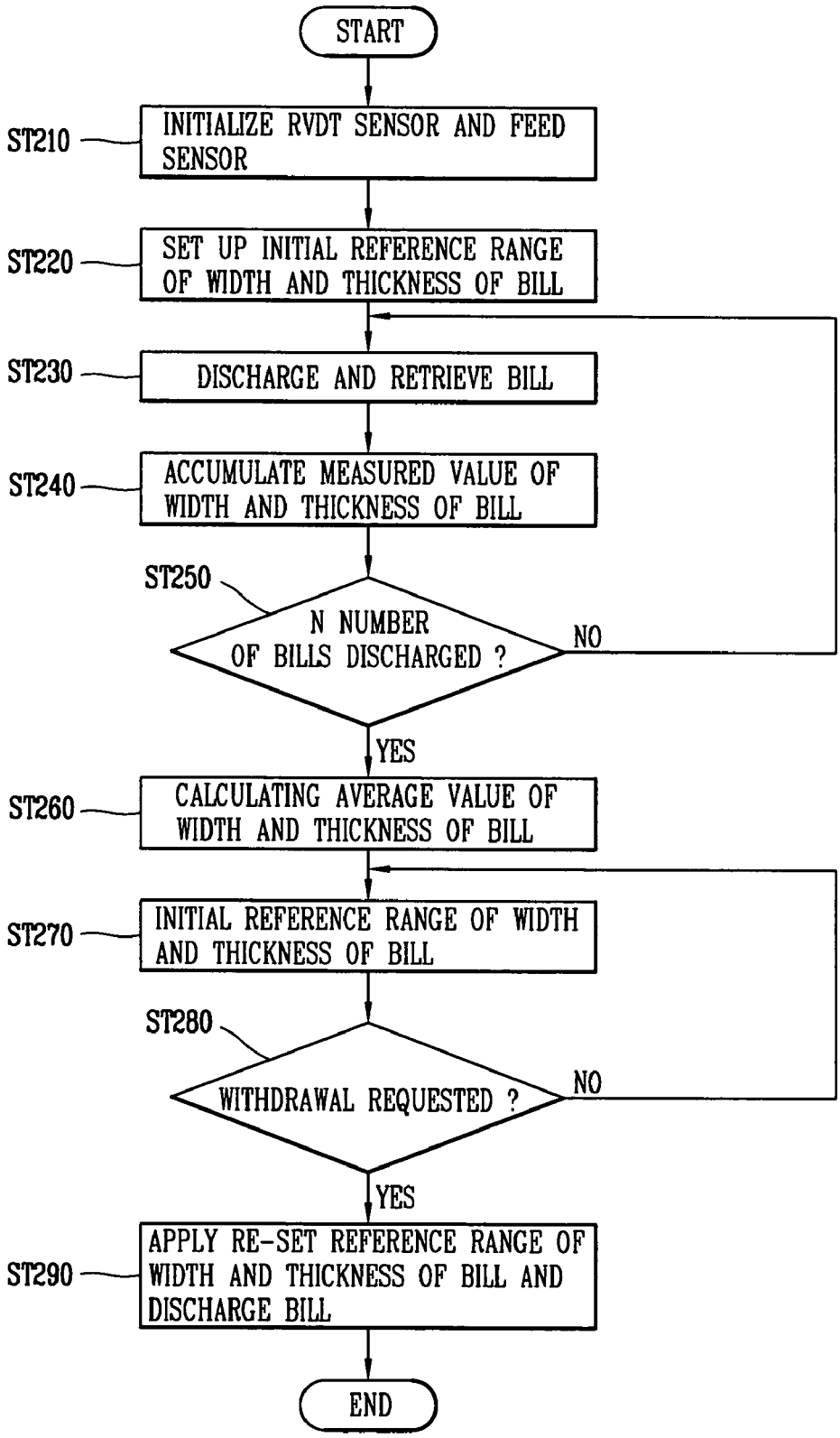
FIG. 6 is a flow chart of a media discriminating method of the media dispenser according to measure of the width and thickness of a media.

FIG. 6 is a flow chart of a media discriminating method of the media dispenser according to measure of the width and thickness of a media.

As shown in FIG. 6, the media sensing method of the media dispenser that is able to accurately measure the width and the thickness of media through the RVDT sensor 700 and the feed sensor 800 will now be described with reference to FIG. 6.

First, when the system is turned on by a user, a series of initial operations are performed to initialize the RVDT sensor 700 and the feed sensor 800 (ST210), and initial reference ranges for the width and the thickness of the media are temporarily set (ST220).

Thereafter, the solenoid and the drive motor are operated to discharge the sample media. The discharged sample media is retrieved into the cassette (ST230). At this time, reference ranges for the thickness and the width of the sample media being currently discharged are set by the RVDT sensor 700 and the feed sensor 800, and the set reference range values are stored through an application of the controller or EEPROM (ST240). For example, 20 sample media are discharged to obtain each average value of the accumulatively stored thickness and width of the media, thereby setting a reference range (ST250 and ST260).

Thereafter, the reference ranges for the thickness and width of the sample media obtained through the above process and the initial reference ranges which have been temporarily set are compared to variably set an initial reference range (ST270).

Thereafter, the variably set reference ranges (or signal levels) and the reference ranges (or signal levels) of media being currently discharged are compared according to an actual media-withdrawal request of a system operator or a client to judge whether the media is normal (ST280). For example, in discriminating the thickness of media, if the thickness comes within the reference range signal level, it is discriminated that one media has been normally discharged, and thus, the currently discharged media is normally discharged.

If, however, the thickness of media goes beyond the reference range signal level, it is discriminated that one or more media is abnormally discharged, and thus, a series of operations are performed to retrieve the currently discharged media to the internal retrieval box (ST290).

Finally, in discharging media, detect signals measured respectively by the RVDT sensor 700 and the feed sensor 800 are accumulatively stored, an average value of the measured values of the accumulatively stored detect signals is calculated, and a corresponding reference range is set to newly update the previously variably set reference range signal level.

Figure 7A:
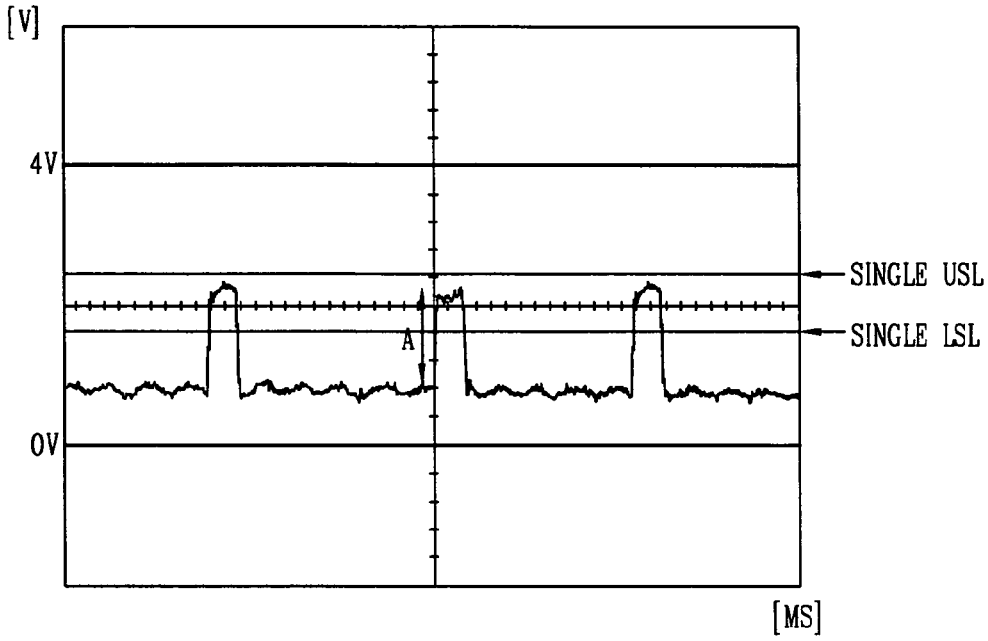
FIG. 7A illustrates a waveform of a thickness detect signal of a media detected by the media discriminating method of the media dispenser in accordance with the present invention.

FIG. 7A illustrates a waveform of a thickness detect signal of a media detected by the media discriminating method of the media dispenser in accordance with the present invention.

As shown in FIG. 7A, the media dispenser of the present invention obtains an average value by accumulatively calculating values (A) of media thickness detect signals which have been actually measured by the RVDT sensor 700, and variably sets an initial reference range signal level which has been temporarily set previously on the basis of the average value.

Figure 7B:
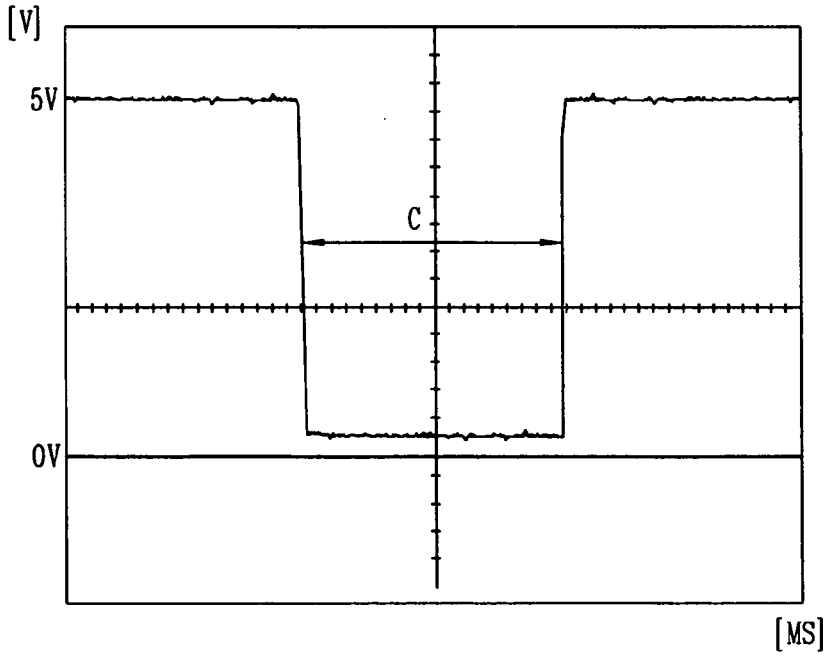
FIG. 7B illustrates waveforms of media width detect signals detected by the media discriminating method of the media dispenser in accordance with the present invention.

FIG. 7B illustrates waveforms of media width detect signals detected by the media discriminating method of the media dispenser in accordance with the present invention.

As shown in FIG. 7B, the media dispenser of the present invention obtains an average value by accumulatively calculating values (C) of the media width detect signal which have been actually measured by the feed sensor 15, and variably sets a reference range signal level which has been temporarily set previously on the basis of the average value.

In another embodiment of the present invention, a method for measuring various foreign bills and various media (multi-media) each having a certain thickness such as a ticket will now be described.

Figure 8:
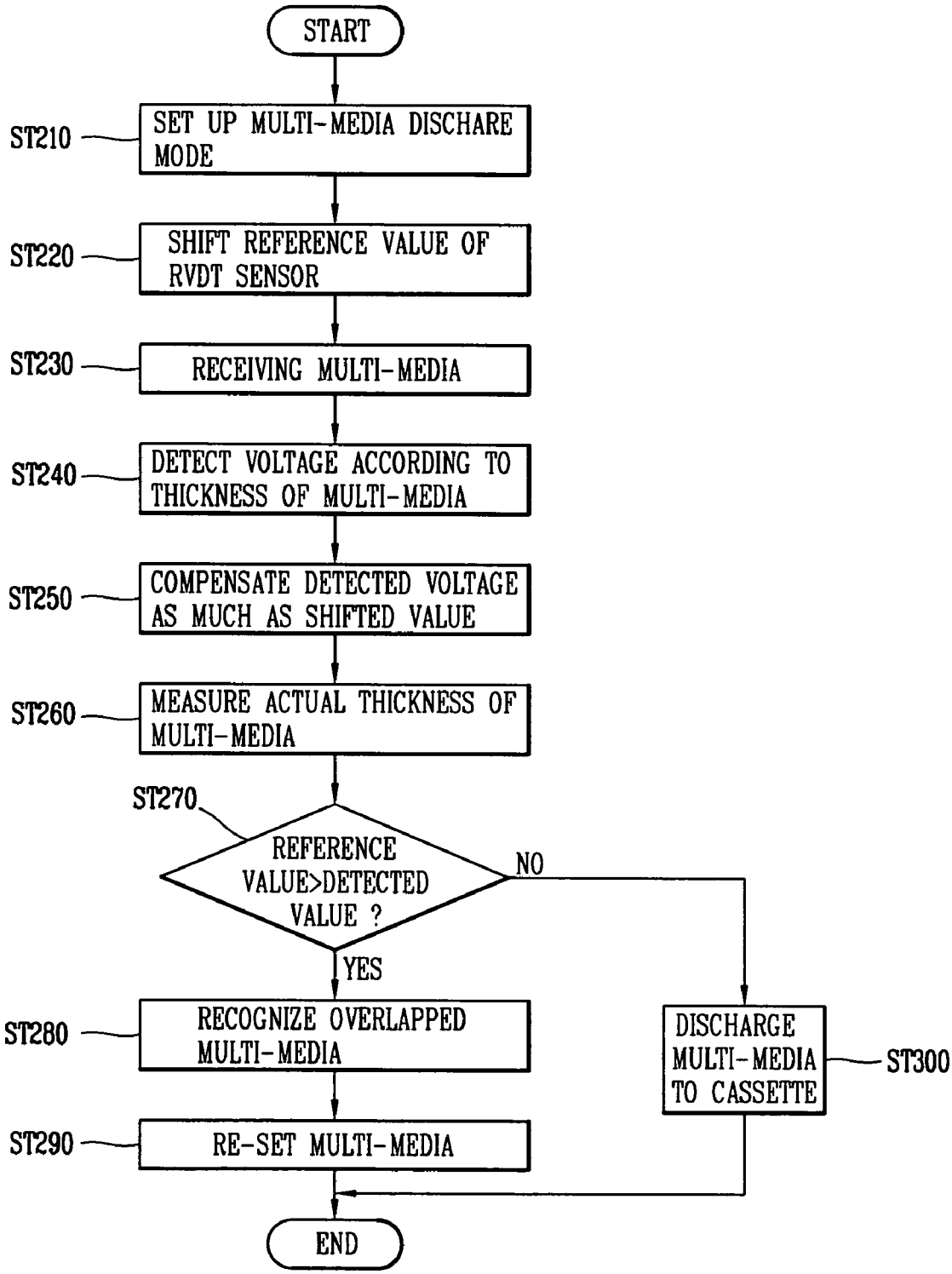
FIG. 8 is a flow chart of a multi-media overlap discriminating method of the media dispenser in accordance with the present invention.

FIG. 8 is a flow chart of a multi-media overlap discriminating method of the media dispenser in accordance with the present invention.

As shown in FIG. 8, a multi-media overlap discriminating method of a media dispenser is as follows.

First, after the RVDT sensor 700 and the feed sensor 800 are initialized, a multi-media discharge mode is set for discriminating the thickness of a multi-media (ST210).

Next, an initial reference range of the RVDT sensor is set by shifting an initial reference range as much as a predetermined value, for measuring the thickness of the multi-media (ST220).

In discharging the multi-media from the cassette, a voltage according to the thickness of the currently discharged multi-media is detected (ST230 and ST240).

And then, the voltage according to the thickness of the multi-media is compensated as much as the predetermined value shifted in the initialization (ST250) in order to precisely measure the actual thickness of the multi-media (ST260). Then, the voltage value according to the thickness of the initial reference range and the voltage value according to the thickness of the currently discharged multi-media (ST270).

Upon comparison, if the detect voltage value of the currently discharged multi-media is greater than the initial reference range voltage value, it is determined that multi-media overlap has occurred and the currently discharged multi-media is rejected (ST280 and ST290). If, however, the detect voltage value of the currently discharged multi-media is smaller than or the same as the initial reference range voltage value, it is determined that the multi-media has a normal thickness and discharging of the multi-media is performed (ST300).

Figure 9A:
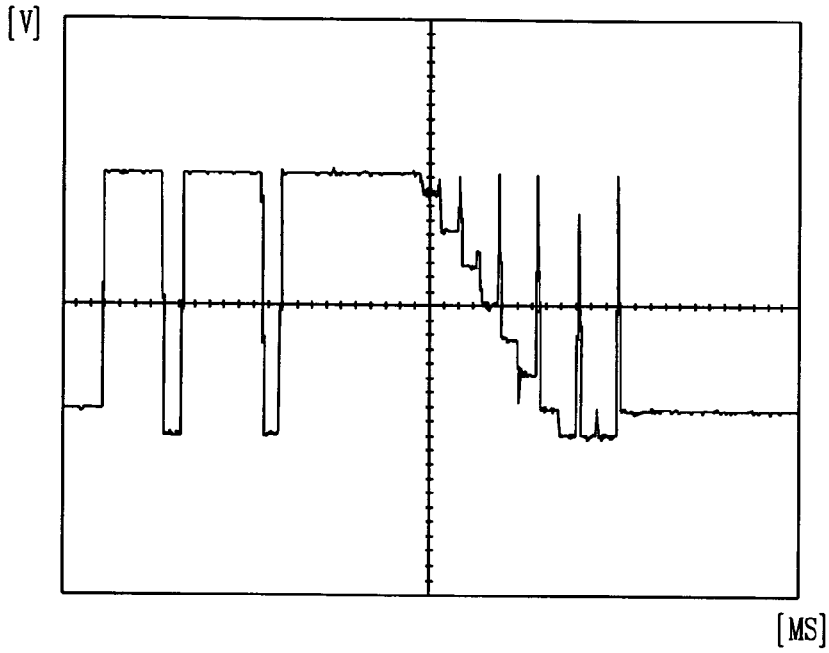
FIG. 9A illustrates a waveform showing an initial value of an RVDT sensor before discharging media.
Figure 9B:
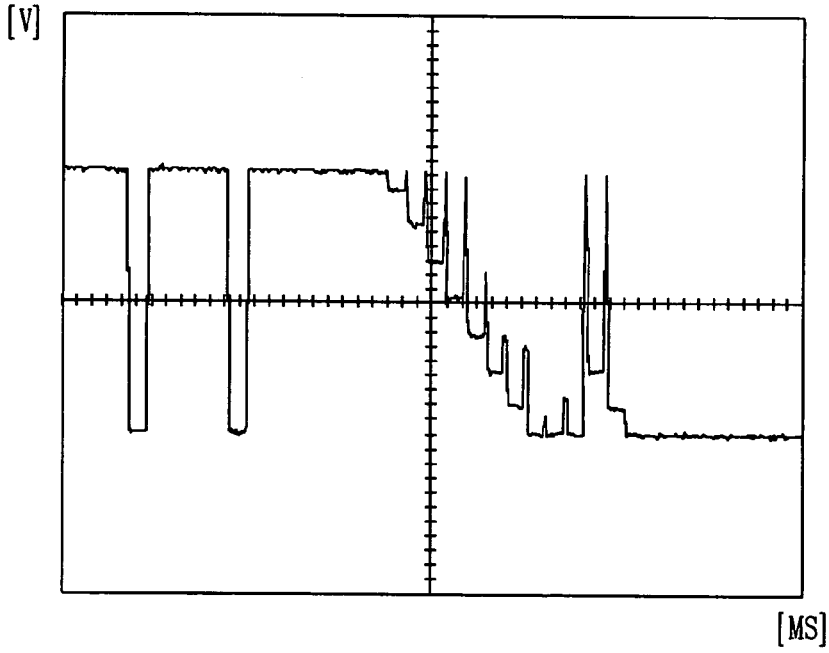
FIG. 9B illustrates a waveform showing an initial value of the RVDT sensor before discharging multi-media having a certain thickness.

FIG. 9A illustrates a waveform showing an initial value of an RVDT sensor before discharging media, and FIG. 9B illustrates a waveform showing an initial value of the RVDT sensor before discharging multi-media having a certain thickness.

As shown in FIGS. 9A and 9B, when the media discharge mode of the media dispenser is set in the multi-media discharge mode, the RVDT sensor shifts the reference value as much as the predetermined value. For example, as the reference value of the RVDT sensor, a shift value having the steps of 0~255 can be set by a digital potentiometer. Herein, the reference value of the RVDT sensor is a four-step up-shifted value compared to the value in discharging the media.

Thereafter, in receiving the multi-media through the cassette, a voltage according to the thickness of the multimedia is detected and compared with the reference value. At this time, assuming that one step difference of the digital potentiometer is about 0.5V, since four steps have been shifted at the initial stage, the actual thickness value is a value obtained by compensating about 2.0V. Accordingly, whether media is normal or abnormal can be determined by measuring the thickness of various media each having a certain thickness such as the ticket.

Figure 10A:
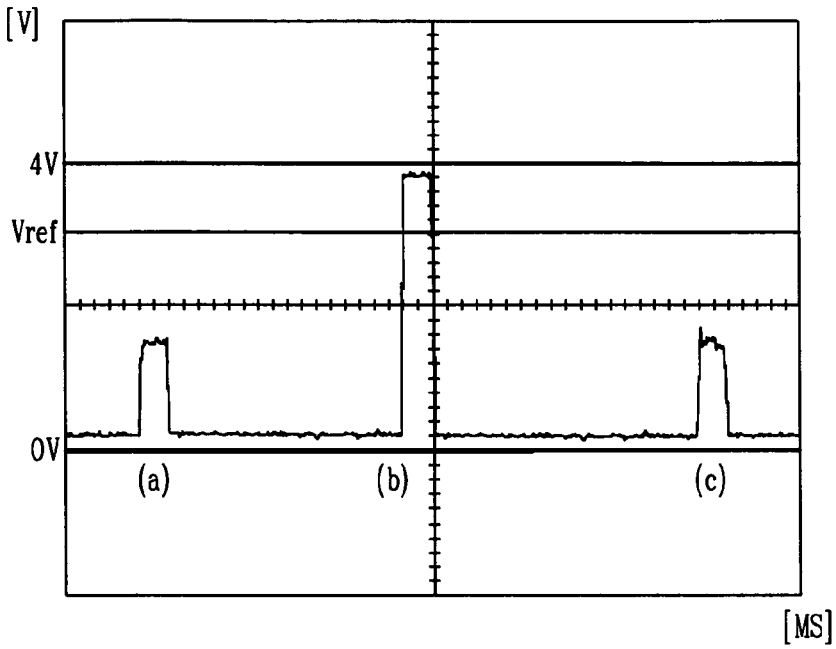
FIG. 10A illustrates a voltage waveform according to the thickness of the same multi-media when the multi-media is outputted from the media dispenser in accordance with the present invention.
Figure 10B:
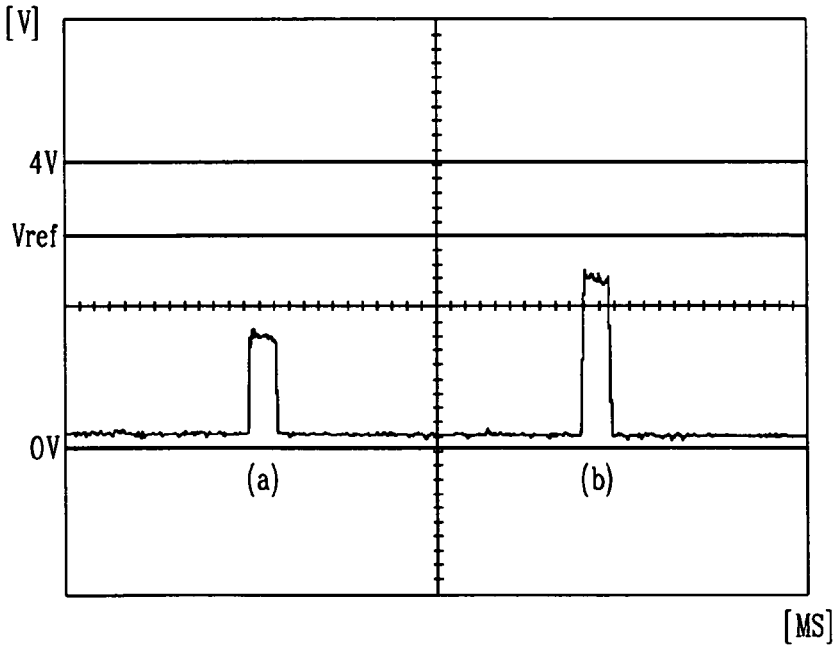
FIG. 10B illustrates a voltage waveform in measuring the thickness of multi-media with different thicknesses when the multi-media is outputted from the media dispenser in accordance with the present invention.

FIG. 10A illustrates a voltage waveform according to the thickness of the same multi-media when the multi-media is outputted from the media dispenser in accordance with the present invention, and FIG. 10B illustrates a voltage waveform in measuring the thickness of multi-media with different thicknesses when the multi-media is outputted from the media dispenser in accordance with the present invention.

With reference to FIG. 10A, as for the determining of the thickness of the media dispenser, if the thickness of multi-media is smaller than the reference values like the cases of (a) and (c), the currently discharged multi-media is determined to be one piece and discharged as it is outwardly. If, however, the thickness of multi-media is greater than the reference value like the case of (b), the currently discharged multi-media is determined to be two pieces and the overlapped multi-media are rejected.

With reference to FIG. 10B, even in the case that multi-media have different thicknesses like the cases of (a) and (b), they can be discriminated to be different by a voltage value having a predetermined range.

As so far described, the media sensing method of a media dispenser in accordance with the present invention has the following advantages.

That is, for example, first, the skew, the length, the thickness of media and a distance between successively discharged media can be discriminated by using the RVDT sensor 70 and the feed sensor 80. Thus, discharged media can be discriminated by using the least sensors. Accordingly, thanks to the simplification of the circuit construction by using the least sensors, a cost reduction can be accomplished in manufacturing the media dispenser.

Second, whether the thickness and width of media can be accurately discriminated by variably setting a reference range signal level for discriminating the normalness of the thickness and width of media discharged through the cassette by accumulatively calculating the plurality of actually measured detect values. Thus, an error due to various environmental conditions or a deflection taking place when setting a sensor can be effectively prevented.

Third, when multi-media is discharged, multi-media overlap can be accurately discriminated and the thickness of discharged multi-media can be precisely measured by shifting a reference value of the RVDT sensor of the media dispenser and comparing it with a voltage according to the thickness of the multi-media.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media sensing method of a media dispenser comprising:

setting an initial reference range for width and thickness of a media;

discriminating the skew, the width, the thickness of the media and a distance between successively discharged media through only a feed sensor and a RVDT (Rotary Variable Differential Transducer) sensor installed at the convey path on which media is moved after being discharged from a cassette in response to a cash withdrawal request;

comparing the initial reference range and a reference range of a currently discharged media; and variably setting a new initial reference range on the basis of the comparison value.

2. The method of claim 1, wherein the initial reference range and the reference range of the currently discharged media is an average value of the width and thickness of media.

3. The method of claim 1, wherein the initial reference range and the reference range of the currently discharged media is a predetermined range of a voltage value set through a digital potentiometer for the width and thickness of the media.

4. The method of claim 1, wherein when the media dispenser is turned on/off, a reference range of the currently discharged media is stored through FEPROM or the pre-set initial reference range is read.

5. The method of claim 1, wherein when the media dispenser is turned on/off, the reference range of the currently discharged media is stored through an application program of the media dispenser or the stored reference range is outputted.

6. The method of claim 1, wherein the width of the media is measured through a feed sensor installed at a convey path on which media is discharged from a cassette storing the media in response to a media supply command, and the thickness of the media is measured through an RVDT (Rotary Variable Differential Transducer) sensor.

7. The method of claim 1, wherein the media is bills of each country or multi-media having a predetermined thickness.

8. The method of claim 7, further comprising discriminating the media discharge mode and the multi-media discharge mode through a dip switch, in order to output the media or the multi-media.

9. The method of claim 7, further comprising respectively generating a media discharge command and multi-media discharge command to output the media or the multi-media.

10. The method of claim 7, further comprising respectively providing a cassette for supplying a bill in case that media is the bill and a cassette for supplying a multi-media when the media is the multi-media in order to individually discharge the bill and the multi-media.

11. The method of claim 7, further comprising supplying the bill and multi-media through one cassette, when the media is a bill and case when the media is the multi-media are determined.

12. The method of claim 1, wherein the initial reference range setting step comprises:

setting a discharge mode for multi-media having a predetermined thickness;

initializing the thickness of multi-media by shifting the initial reference range of the RVDT sensor measuring the thickness of the multi-media as much as a predetermined value; and determining an average value of width and thickness by discharging and retrieving a number of said multi-media.

13. The method of claim 12, wherein the step of comparing the reference range comprises:

detecting a voltage according to the thickness of the currently discharged multi-media in discharging the multi-media; and comparing the voltage value according to the thickness of the initial reference range and the voltage value according to the thickness of the currently discharged multi-media.

14. The method of claim 13 further comprises:

determining whether multi-media have overlapped by comparing the voltage values; and rejecting the discharged multi-media if the multi-media have overlapped, and outputting the discharged multi-media if the multi-media have not been overlapped.

15. The method of claim 1, wherein, as for the discrimination of skew of media, skew of media is determined by a sequential order of the RVDT sensor and the feed sensor.

16. The method of claim 1, wherein, as for the discrimination of the length of media, the length of media is determined by measuring ON/OFF time of the feed sensor while the media is moved along the convey path and ON/OFF time of the feed sensor in a pre-set normal state.

17. The method of claim 1, wherein, as for the discrimination of the thickness of media, when media is conveyed between the RVDT sensor, a sensing unit of the RVDT sensor is lifted up as long as the thickness of the media, according to which the thickness of media is determined by a difference value between the value of the sense signal of the RVDT sensor and the pre-set sense signal value.

18. The method of claim 1, wherein, as for the discrimination of a distance between media, the distance between media is determined by comparing ON/OFF time of the feed sensor of the first media and ON time of the feed sensor of the next media.

19. The method of claim 1, wherein the feed sensor is an optical sensor for measuring ON/OFF time of media, and comprises:

a light emitting unit for radiating light; and a light receiving unit disposed at an interval from the light emitting unit and sensing light radiated from the light emitting unit.

20. The method of claim 19, wherein when media is not sensed, the light receiving unit of the feed sensor outputs 5V, and when light radiated from the light emitting unit is interrupted by media when the media discharged from the media-storing cassette is passing through the convey path where the feed sensor is installed, the light receiving unit outputs 0V.

21. The method of claim 1 further comprises:

checking whether the feed sensor and the RVDT (Rotary Variable Differential Transducer) sensor are normal in response to a cash withdrawal request of a user;

discharging media by virtue of a driving force transmitted to the convey roller connected to the cassette; and retrieving media when media in an abnormal state is sensed in the discriminating step of each media.

22. The method of claim 21, wherein the driving force is generated by the operation of a DC motor, and preferably, by a BLDC (Brushless DC) motor.

23. The method of claim 21 further comprises:

sensing and counting the retrieved media.

24. A media sensing method of a media dispenser comprising:

setting a multi-media discharge mode;

setting an initial reference range by shifting a reference value of an RVDT (Rotary Variable Differential Transducer) sensor as much as a predetermined value;

receiving a multi-media and detecting a voltage according to the thickness of the multi-media;

comparing a voltage value according to the thickness of the initial reference range and a voltage value according to the thickness of the currently discharged multi-media; and rejecting the currently discharged multi-media if the detected voltage value of the currently discharged multi-media is greater than the initial reference range voltage value, and discharging the multi-media if the detected voltage value of the currently discharged multi-media is smaller than or the same as the initial reference range voltage value.

25. The method of claim 24 further comprising:

generating a media discharge command signal and a multi-media discharge command signal, and setting an each-country bill discharge mode and a multi-media discharge mode;

compensating as much as a certain shifted value in initializing a voltage according to the thickness of the multi-media, and precisely measuring the actual thickness of the multi-media.

26. The method of claim 24, wherein the multi-media discharge mode setting step comprises:

setting the each-country bill discharge mode and the multi-media discharge mode by using a dip switch.

27. A media sensing method of a media dispenser comprising:

setting an initial reference range for width and thickness of a media;

obtaining an average value of thickness and width of bills accumulatively stored by discharging sample media and setting a reference range;

comparing the reference range for the thickness and width of the sample media and the initial reference range, and variably setting the initial reference range; and respectively comparing the variably-set reference range and a reference range of a currently discharged media according to a media withdrawal request, and determining whether the media is normal or not.

28. The method of claim 27 further comprising:

initializing the RVDT (Rotary Variable Differential Transducer) sensor and the feed sensor upon receiving system power by a user; and normally discharging media to an external discharge box or retrieving media to an internal retrieval box depending the discrimination result about whether the media is normal or abnormal.

29. The method of claim 27, wherein the thickness of media is detected by the RVDT (Rotary Variable Differential Transducer) sensor and the width of media is detected by the feed sensor.

* * * * *